US005263325A

United States Patent [19]

McVey et al.

[11] Patent Number: 5,263,325

[45] Date of Patent: Nov. 23, 1993

[54] LOW NOX COMBUSTION

[75] Inventors: John B. McVey, Glastonbury; Thomas J. Rosfjord, South Windsor, both of Conn.

[73] Assignee: United Technologies Corporation, Hartford, Conn.

[21] Appl. No.: 807,483

[22] Filed: Dec. 16, 1991

[51] Int. Cl.[5] ..... F02C 7/08

[52] U.S. Cl. ..... 60/738; 60/739; 60/39.826

[58] Field of Search ..... 60/738, 737, 39.826, 60/739; 431/326, 328, 354, 283, 284, 285, 8

[56] References Cited

U.S. PATENT DOCUMENTS

| | | | |
|---|---|---|---|
| 2,850,875 | 9/1958 | Gähwyler | 60/749 |
| 2,935,128 | 5/1960 | Ferguson | 431/284 |
| 3,685,950 | 8/1972 | Nomaguchi et al. | 431/285 |
| 4,100,733 | 7/1978 | Striebel et al. | 60/737 |
| 4,618,323 | 10/1986 | Mansour | 431/284 |
| 4,967,561 | 11/1990 | Brühwiler et al. | 60/737 |
| 5,094,610 | 3/1992 | Mandai et al. | 431/183 |
| 5,121,608 | 6/1992 | Willis et al. | 60/737 |

FOREIGN PATENT DOCUMENTS

| | | | |
|---|---|---|---|
| 0071737 | 6/1977 | Japan | 431/289 |

OTHER PUBLICATIONS

John B. McVey & Jan B. Kennedy, "Lean Stability Augmentation for Premixing, Prevaporizing Combustors", Journal of Energy, vol. 4, Jul. 1980, pp. 7, 8, 11.

*Primary Examiner*—Richard A. Bertsch
*Assistant Examiner*—Timothy S. Thorpe

[57] ABSTRACT

A burner for a gas turbine combustor has a perforated plate facing the combustor and a plurality of gaseous fuel premixing tubes conveying a lean premixed fuel through the plate. A gas pilot extending through the plate projects jets of fuel parallel to the plate between the tube locations nearest the pilot. Ignition stability at turndown is maintained.

5 Claims, 4 Drawing Sheets

LOW NOX COMBUSTION

DESCRIPTION

1. Technical Field

The invention relates to low NOx burners for gas turbines engines, and in particular to stabilization and combustion efficiency improvement of the lean burner.

2. Background of the Invention

Nitric oxide emissions from gas turbine engines contribute to the production of photochemical smog. An effective strategy for reducing combustor-generated $NO_x$ is to lower the flame temperature by mixing the air and fuel (prior to combustion) in proportions so the overall mixture is fuel-lean. If the combustor is designed to operate with a lean mixture at full-power conditions, then as fuel flow is reduced to part power conditions, the premixed air system becomes too lean to support stable combustion. As a result, some strategy must be used to sustain combustion. Examples are the use of staging wherein selected combustion zones are shut down so that the remaining zones are enriched, or the use of variable geometry air passages wherein a portion of the air which would normally enter the combustion chamber is bypassed around the combustion chamber so that the combustion chamber mixture is enriched.

All strategies for increasing the range of operation of lean premixed combustion entail some compromise. For example, the use of staging complicates the fuel control system and requires additional cooled combustor walls which separate the combustion zones. The use of variable geometry burn passages compromises cost and reliability. A strategy which minimizes the penalties incurred is sought.

SUMMARY OF THE INVENTION

In accordance with this invention a small quantity of pilot fuel is injected into those portions of the combustion zone where a small degree of enrichment will result in a large increase in low power combustion efficiency as well as an increase in flame stability over an increased operating range. In "Lean Stability Augmentation for Premixing, Prevaporizing Combustors" by John by McVey and John B. Kennedy, Journal of Energy, Vol. 4, 1980, a liquid fuel lean, premixed combustion system using a perforated plate flameholder is described. It was shown that the use of a centrally located 85° cone oil spray produced major improvements in combustor performance.

The invention involves the application of piloted combustion to a gas fired low NOx burner. Air and gaseous fuel are completely mixed in an array of premixing tubes. The method of injection of this main fuel into the air stream is not critical except that the distance from the point of injection to the point of combustion must be sufficient to achieve near complete mixing. Methods of augmenting the mixing by use of turbulence generators or other devices are acceptable.

The time required for complete mixing to be achieved must be less than the autoignition time. Accordingly, some difficulty may be expected in avoiding premature autoignition in high pressure ratio engines which produce high compressor discharge temperatures.

The fuel air mixture is discharged from the tubes into the base region of the burner bulkhead which resembles a perforated surface. A multiplicity of tubes are used so the characteristic size of each recirculation zone formed between tubes is small. A small recirculation zone dimension leads to a short combustion product residence time in the recirculation region. This is also beneficial for the achievement of low nitric oxide emissions. The ratio of open area to total area of the combustor bulkhead should be approximately 0.2 in order to achieve good stability with reasonable combustor pressure loss.

The recirculation zone around each injection point includes hot combustion products and also excess oxygen because of the overall lean burner. The injection of of pilot fuel into this zone permits the pilot fuel to start burning in the presence of this hot oxygen. The pilot fuel is introduced parallel to the face of the bulkhead in a manner to be mixed with the recirculating gas residing in or associated with each of the individual recirculating regions. This parallel introduction of the pilot fuel permits the transverse gas jets to penetrate the low momentum recirculating regions. The number and orientation of jets is selected so that most or all of the recirculating flow are penetrated by the pilot gas jet.

DESCRIPTION OF THE PREFERRED EMBODIMENT

Figure 1:
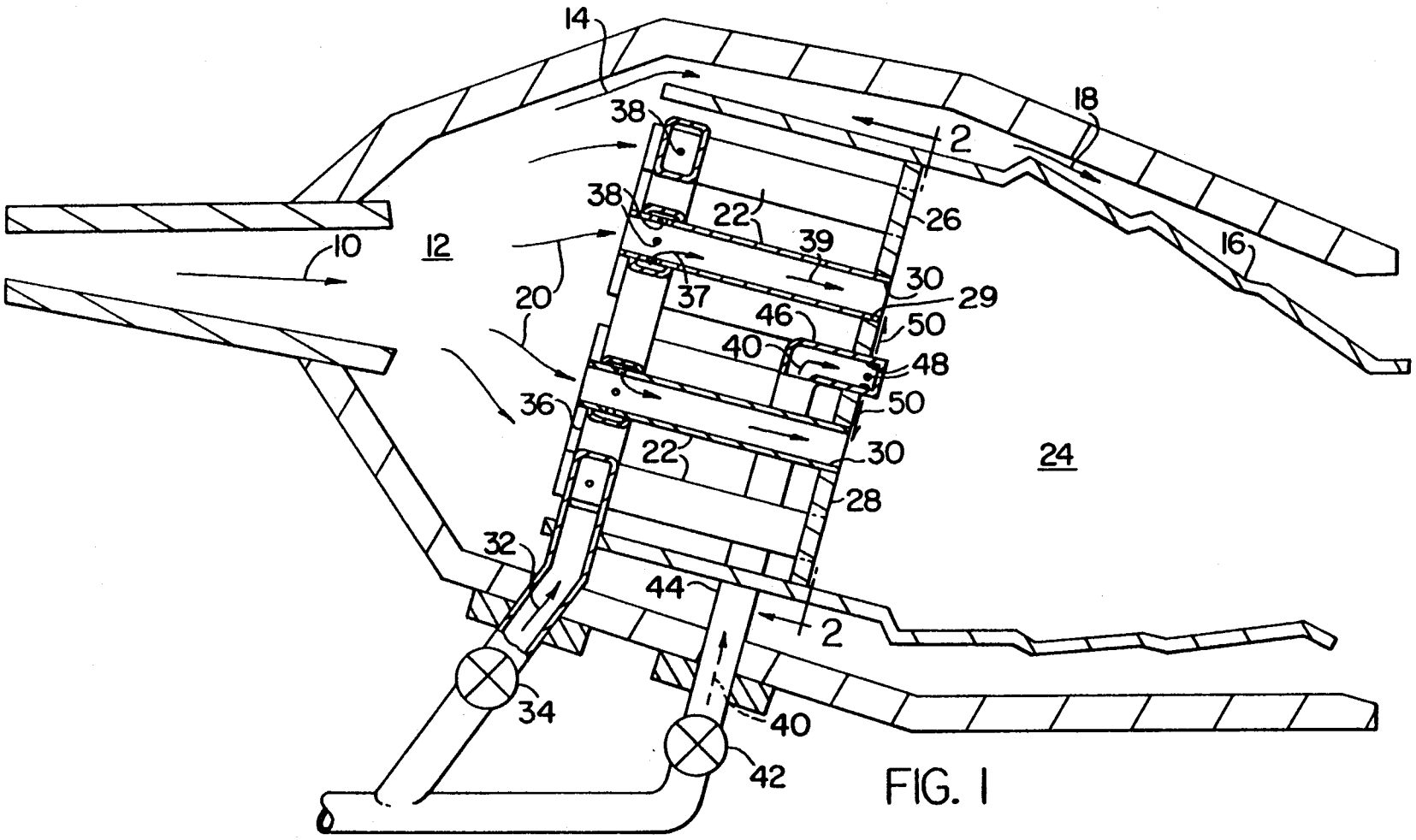
FIG. 1 is a sectional elevation through a burner in a can combustor.

Referring to FIG. 1, airflow 10 from the compressor of a gas turbine engine passes to plenum 12. From here, 35 percent of the airflow 14 passes around and through the wall of combustor liner 16 as cooling and dilution airflow 18. The remaining 65 percent of the flow 20 passes through a plurality of premixing tubes 22 and into combustor 24.

The bulkhead or flameholder plate 26 has a face 28 facing the combustor.

There are a plurality of axial perforations 29 in a direction perpendicular to said face through the flameholder with the gaseous fuel premixing tube 22 extending through each perforation. These tubes terminate with an open end 30 at the face of plate 26.

The main gas fuel flow 32 may be modulated by valve 34 and passes into header 36. From this header it passes as flow 37 through openings 38 into the fuel premixing tubes where it mixes with the air as it traverses the length of each tube. A lean air fuel mixture 39 thereby leaves these tubes into the combustor. This mixture is ignited in the conventional manner providing a plurality of individual flames at the front of flameholder plate 26 and in combustor 24.

Pilot fuel 40, modulated when required by the valve 42, passes through line 44 into pilot tube 46. This pilot tube extends slightly past the front face and has a plurality of pilot jet openings 48 directing pilot fuel 50 substantially parallel to the face 28 of the flameholder plate 26.

Figure 2:
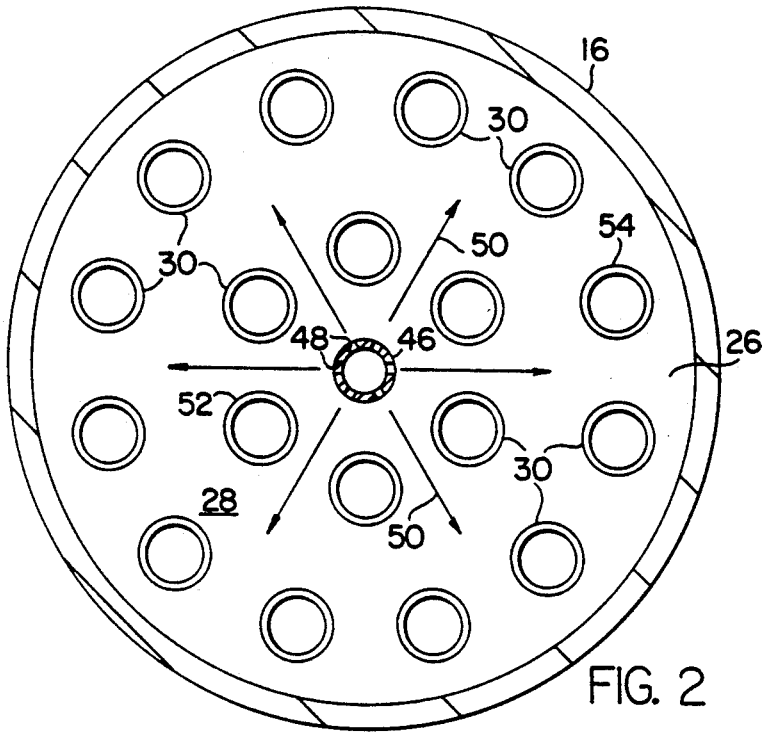
FIG. 2 is a front view of the burner of FIG. 1.

The pattern of the pilot fuel introduction is better seen in FIG. 2. The jet of pilot fuel 50 is directed to pass between imaginary extensions of the mixing tubes 52 closest to the gas pilots. This permits a portion of the pilot gas flow to continue to a zone adjacent to the mixing tubes 54 which are more remote from the pilot.

At full load operation of the gas turbine engine, about 5 percent of the total gaseous fuel is introduced as pilot jets. At such time the air temperature is elevated, being about 850° F. for a 20:1 pressure ratio engine. At reduced load operation, the fuel tends to decrease more than the airflow thereby resulting in an even leaner fuel-air mixture leaving the mixing tubes. Furthermore, the air temperature drops to a reduced level at idle, 400° F. being typical for a moderate pressure ratio engine.

Preferably the quantity of fuel entering from the pilot jets is kept substantially constant by not modulating the valve 42 as load is decreased. All the load decrease occurs by modulating valve 34. Because of the lower temperature of air, the higher fuel air ratio at the pilot area can be tolerated without increasing the NOx. Furthermore, the stability of the lean flame is increased as is the combustion efficiency.

Figure 3:
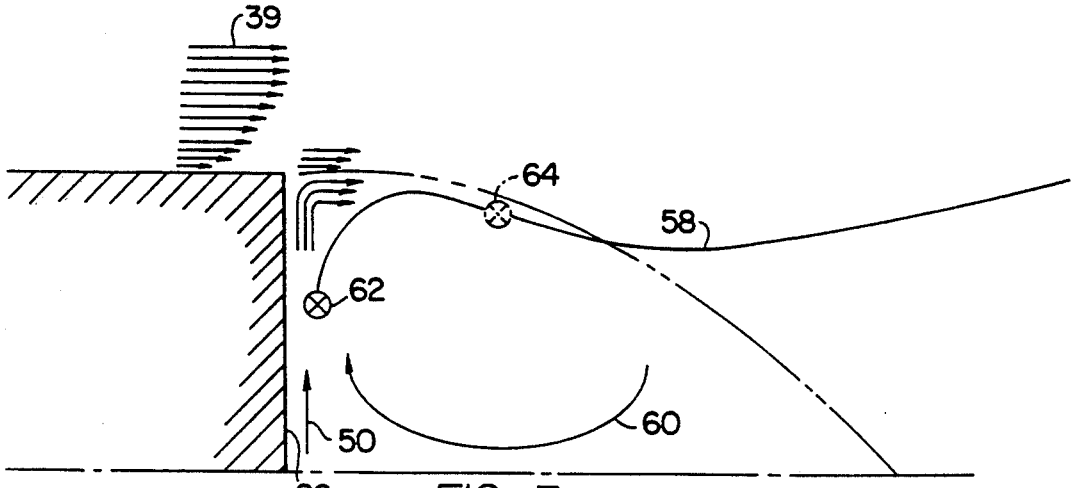
FIG. 3 is a schematic showing gas flow in the combustion zone.

Referring now to FIG. 3, the incoming air-fuel mixture 39 burns substantially within flame envelope 58 with hot combustion products and oxygen recirculating as recirculating flow 60. This is a hot relatively oxygen rich gas. The pilot fuel 50 being heated by radiation and contact with recirculating gas tends to form an ignition point 62 near the base of the flame. Ordinarily, ignition would start at point 64 with fuel being supplied by transport from the lean incoming air-fuel mixture 39. With the introduction of the pilot fuel 50 the ensuing heating local rich mixture establishes ignition and combustion with a fuel-rich, very concentrated local zone. The effect is to provide stabilization of the flame and to improve the combustion efficiency. Since this is such a small quantity of high temperature of high temperature gas, the increase in NOx of the pilot is negligible associated with the use.

Figure 4:
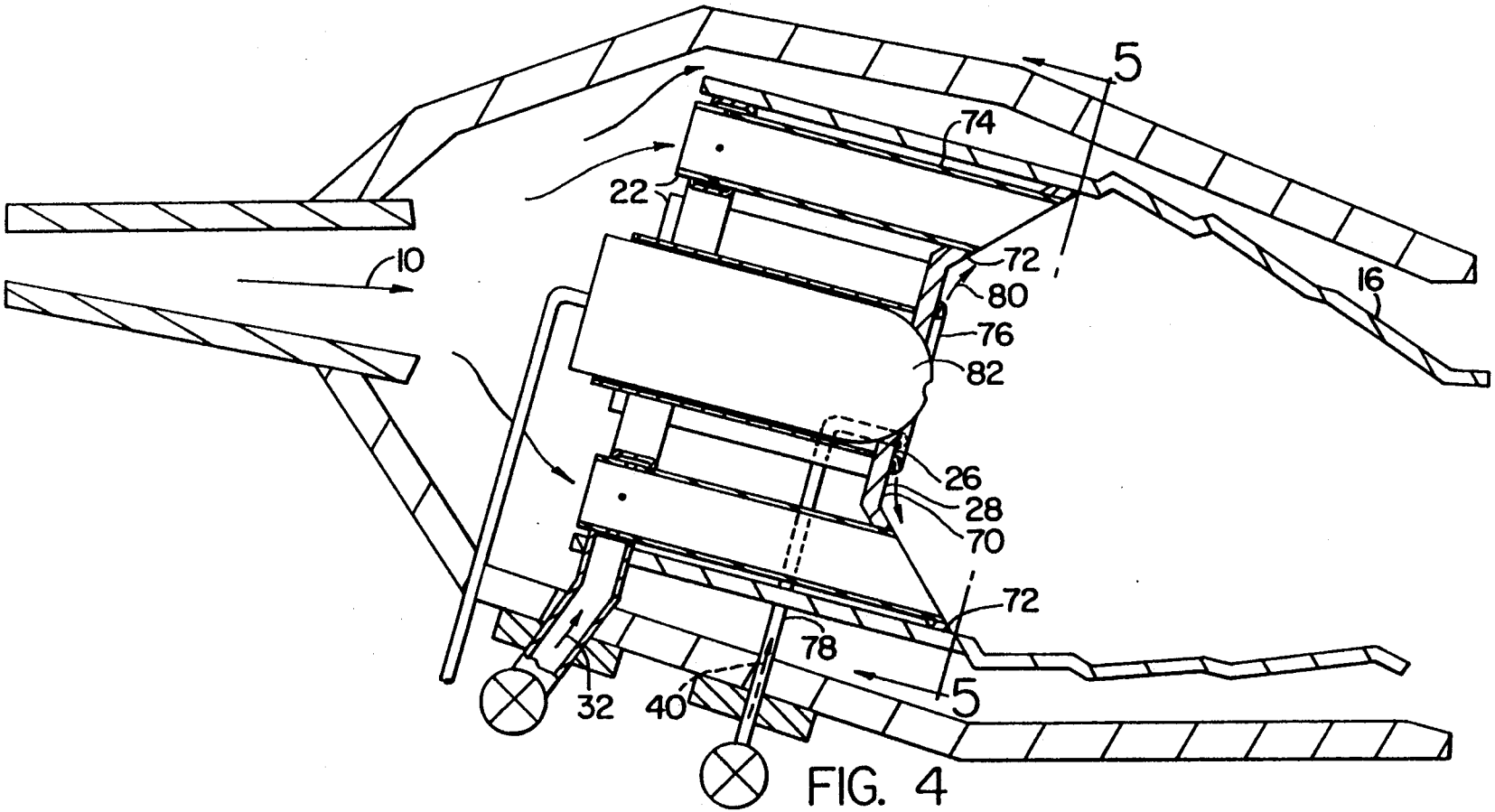
FIG. 4 is a sectional elevation through a burner in an annular combustor.

FIG. 4 illustrates a burner in an annular combustor. The front face 28 of an annular flameholder plate 26 is folded to provide a central face portion 70 which is substantially perpendicular to the mixing tubes 22 and to contiguous face portions 72 at an angle of 45° and preferably less than 50° from the central face portion 70. Some of the mixing tubes 74 extend through the extending face portions.

The pilot tube as illustrated here has an annular ring 76 receiving gas from supply tube 78.

The gas jets 80 are directed toward impingement on the surrounding face portion, this being an attempt to continue the concept of introducing a pilot fuel parallel to the faceplate in light of the folded plate shown herein.

In this particular embodiment a central oil gun 82 is illustrated for the purpose of providing dual fuel (oil and gas) capability.

Figure 5:
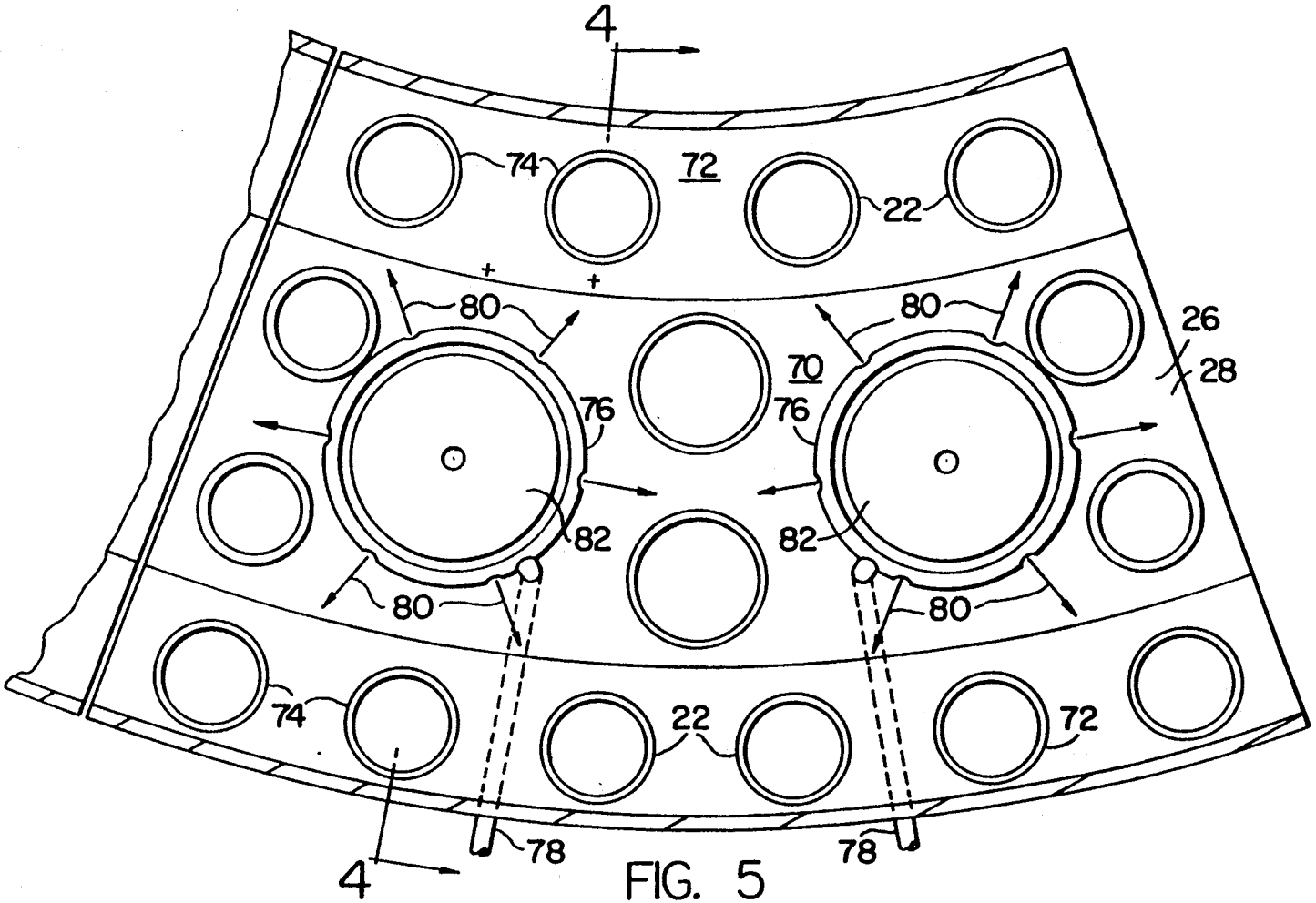
FIG. 5 is a front view of the burner of FIG. 4.

FIG. 5 illustrates the orientation of pilot jets 80 passing between imaginary extensions of the mixing tubes closest to the pilot. In this case the pilot projection does project toward the impingement on the more remote hypothetical extensions.

We claim:

1. A low NOx burner for the combustor of a gas turbine comprising:

a flame holder plate having a face facing the combustor;

a plurality of perforations through said plate in a direction perpendicular to said face;

a gaseous fuel premixing tube extending through each perforation terminating with an open end at the face of said plate;

at least one gas pilot tube extending axially through said plate, said gas pilot tube having a combustor end and extending through the face of said plate, each gas pilot tube located amid the plurality of surrounding fuel premixing tubes;

a plurality of pilot jet openings in the combustor end of each pilot tube, each directing a jet of fuel substantially parallel to the face of said plate to zones between imaginary extensions of said fuel mixing tubes closest to said gas pilots; and air passage means for directing a portion of the gas turbine airflow through said premixing tubes comprising a plenum for receiving gas turbine airflow and said premixing tubes in fluid communication with said plenum whereby at least a portion of the gas turbine airflow passes through said premixing tubes.

2. A low NOx burner as in claim 1 comprising also:

a first modulating means for varying main fuel flow into said premixing tubes; and pilot fuel delivery means for delivering fuel to said pilot tubes.

3. A low NOx burner as in claim 2 comprising also:

second modulating means for varying pilot fuel independent of said first modulating means.

4. A low NOx burner as in claim 1 comprising also:

a plurality of flame holder plates arranged in an annular array, each plate formed with said face folded to provide a central face portion substantially perpendicular to said mixing tubes, and two surrounding contiguous face portions at an angle of less than 50° from said central face portion;

some of said mixing tubes extending through said surrounding face portions; and said pilot jet openings directing flow substantially parallel to the face, comprising a pilot tube directing a portion of the flow toward impingement on said surrounding face portions.

5. A low NOx burner as in claim 3 comprising also;

a plurality of flame holder plates arranged in an annular array, each plate formed with said face folded to provide a central face portion substantially perpendicular to said mixing tubes, and two surrounding contiguous face portions at an angle of less than 50° from said central face portion;

some of said mixing tubes extending through said surrounding face portions; and said pilot fuel directing flow substantially parallel to said face comprising a pilot tube directing a portion of the flow toward impingement in said surrounding face portions.

* * * * *